US009606568B2

(12) United States Patent
Nirmaier et al.

(10) Patent No.: US 9,606,568 B2
(45) Date of Patent: Mar. 28, 2017

(54) DYNAMICALLY ADAPTING DEVICE OPERATIONS TO HANDLE CHANGES IN POWER QUALITY

(71) Applicant: Infineon Technologies AG, Neubiberg (DE)

(72) Inventors: Thomas Nirmaier, Munich (DE); Georg Pelz, Ebersberg (DE); Manuel Harrant, Taufkirchen (DE)

(73) Assignee: Infineon Technologies AG, Neubiberg (DE)

( * ) Notice: Subject to any disclaimer, the term of this patent is extended or adjusted under 35 U.S.C. 154(b) by 96 days.

(21) Appl. No.: 14/622,190

(22) Filed: Feb. 13, 2015

(65) Prior Publication Data

US 2016/0239039 A1 Aug. 18, 2016

(51) Int. Cl.
*G05F 5/00* (2006.01)

(52) U.S. Cl.
CPC ..... *G05F 5/00* (2013.01)

(58) Field of Classification Search
None
See application file for complete search history.

(56) References Cited

U.S. PATENT DOCUMENTS 7,225,087 B1 * 5/2007 Siciliano ..... H02J 3/38 702/58
2002/0185982 A1 * 12/2002 Shen ..... H05B 41/28 315/291
2007/0029979 A1 * 2/2007 Williams ..... G05F 1/66 323/217
2007/0241614 A1 * 10/2007 Busdiecker ..... H02J 1/14 307/10.1
2010/0053830 A1 * 3/2010 Andersson ..... G05F 1/00 361/91.1
2014/0126255 A1 * 5/2014 Wilmot ..... H02H 9/041 363/56.01

OTHER PUBLICATIONS

"Wavelet Definition," Wikipedia, the free encyclopedia, retrieved from http://en.wikipedia.org/w/index.php?title=Wavelet&oldid=659410111, Apr. 27, 2015, 8 pp.

* cited by examiner

*Primary Examiner* — Jeffrey Gblende
(74) *Attorney, Agent, or Firm* — Shumaker & Sieffert, P.A.

(57) ABSTRACT

A system is described that includes a power bus, a power source configured to supply power to the power bus, and a device receiving at least some of the power supplied by the power source. The device is configured to determine a quality level of the power received from the power bus, and perform an operation of the device according to the quality level of the power. The quality level of the power may be determined on an output from a wavelet transform. For example, the device may apply a wavelet transform to a function based on the power, isolate disturbances from the output of the wavelet transform, and based on the disturbances, determine the quality level of the power.

17 Claims, 9 Drawing Sheets

DYNAMICALLY ADAPTING DEVICE OPERATIONS TO HANDLE CHANGES IN POWER QUALITY

BACKGROUND

Some systems include a shared or common power bus that provides power to one or more electrical devices. For example, a typical automobile has an automotive power net. A power source, such as an alternator or battery, outputs power to the automotive power net and an electrical device, such as an electronic control unit (ECU), receives power from the automotive power net to perform an operation.

Unfortunately, by the time the power reaches a device from a shared power bus, the power may not be of high quality and free from disturbances. That is, the harsh environmental conditions (e.g., electro-magnetic interference, noise, or other undesirable conductions) surrounding the shared power bus, as well as the constantly changing operational states of the different devices that are simultaneously supplied power from the shared power bus, may introduce disturbances onto the bus (e.g., over voltage or current conditions, under voltage or current conditions, load dumps, voltage ringing, voltage or current spikes, as well as large and small electrical transients) and diminish the quality of the power. To compensate for low quality power, some systems include additional, often expensive filter components or operate less efficiently, relying on techniques that require a constant increase in energy consumption.

SUMMARY

In general, circuits and techniques are described for enabling a device to dynamically adapt its power consumption and/or functionality to handle degradations in the quality of the power the device is supplied from a power bus. An example device may perform power stability detection techniques against the power it receives to identify any disturbances (e.g., over voltage or current conditions, under voltage or current conditions, load dumps, voltage ringing, voltage or current spikes, large and small electrical transients, and the like) associated with the power. For example, the device may sample the power and using wavelet or Fourier transforms, identify, from the sampled power any disturbances in the power.

By applying wavelet or Fourier transforms to the sampled signal, the device may determine the power is of high quality if free from any disturbances or of low quality if inclusive of some disturbances. When the device determines that the power has changed from being of high quality to being of low quality, the device may adapt its power consumption and/or functionality to compensate for the change in the quality of the power. For example, the device may initially operate by providing maximum functionality with a greatest amount of efficiency while the power is of high quality. But when the device determines that the power is of low quality, the device may dynamically adapts its power consumption (e.g., increase power consumption) to compensate for disturbances in the power and as a result, operate with reduced efficiency and/or by providing only limited functional capability.

In one example, the disclosure is directed to a system that includes a power bus and a power source configured to supply power to the power bus. The system further includes a device configured to receive, from the power bus, at least some of the power supplied by the power source. The device is further configured to determine a quality level of the power received from the power bus and perform an operation of the device according to the quality level of the power.

In another example, the disclosure is directed to a method that includes receiving, by a device, from a power bus coupled to a power source, at least some of power supplied by the power source. The method further includes determining, by the device, a quality level of the power received from the power bus, and performing, by the device, an operation of the device according to the quality level of the power.

In another example, the disclosure is directed to a system that includes a power bus, a power source configured to supply power to the power bus, an operational module, and a test module. The operational module is configured to receive, from the power bus, at least some of the power supplied by the power source, and perform an operation according to the quality level of the power by at least generating an output based on the power. The test module is configured to test the operational module by at least: generating, based on a wavelet transform applied to the output, a temporal signal including disturbances that simulate a degradation in quality level, detected by the operational module, of the power being received from the power bus, and determining whether the operational module correctly performed the operation in response to the input of the disturbances The details of one or more examples are set forth in the accompanying drawings and the description below. Other features, objects, and advantages of the disclosure will be apparent from the description and drawings, and from the claims.

DETAILED DESCRIPTION

Figure 1:
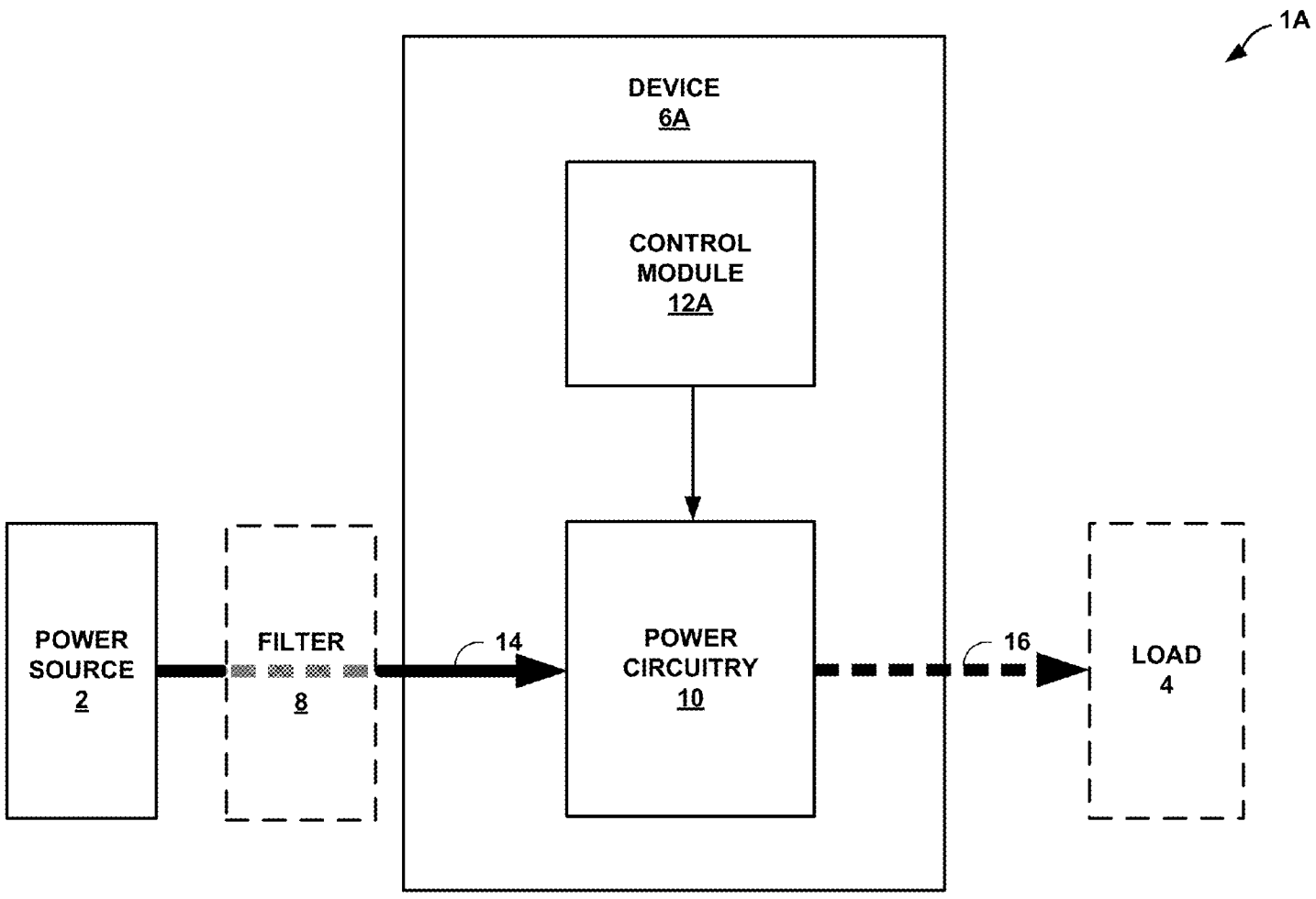
FIG. 1 is a conceptual diagram illustrating a typical system that includes a device configured to receive power from a power bus.

In general, circuits and techniques are described for enabling a device to dynamically adapt its power consumption and/or functionality to handle degradations in the quality of the power the device receives from a power bus. An example device, such as an electronic control unit (ECU), may receive power from a power source to perform an operation. The device may perform power stability detection techniques against the power received from the power source to identify any disturbances associated with the power (e.g., over voltage or current conditions, under voltage or current conditions, load dumps, voltage ringing, voltage or current spikes, large and small electrical transients, and the like). For example, by applying wavelet or Fourier transforms, the device can identify disturbances (e.g., appearing as high frequency oscillations with high or low amplitude peaks, oscillations with sinusoidal shape, oscillations with rectangular or other shapes, or other types of disturbances) in the power to determine whether the power is of high quality or of low quality.

As used herein, when referring to high quality power, the voltage or current associated with the power does not contain or is at least, substantially free from most or all disturbances (e.g., an over-voltage or over-current condition, an under-voltage or under-current condition, a load dump condition, a voltage-ringing or current-ringing condition, a voltage-spike or current spike condition, a voltage or current transient, or some other high frequency oscillations). When referring to low quality power, the voltage or current associated with the power includes one or more disturbances so the power is not considered to be substantially free from most or all disturbances.

When the device determines that the power is sufficiently of high quality and free from disturbances, the device may function in a way that benefits from the fact that the power is of high quality (e.g., maximum functionality, greatest efficiency, or other benefits of a of high quality power signal). However, in response to detecting certain disturbances in the power, the device may determine the power is of low quality or otherwise, not of high quality. When the device determines that the power has changed from being of high quality to being of low quality, the device may adapt its power consumption and/or functionality to compensate for the change in the quality of the power so as to maintain functionality using the low quality power.

For example, the device may initially operate by providing maximum functionality with a greatest amount of efficiency while the power is of high quality. But when the device determines that the power is of low quality, the device may dynamically adapt its power consumption and/or functionality to compensate for disturbances in the power. For example, the device may increase power consumption to compensate for the disturbances or provide only limited functional capability while the power is not of high quality. As a consequence of receiving low quality power, the device may intentionally operate with reduced efficiency so as to ensure that the device continues to provide at least some functionality. When the device determines that the quality of the power has improved, the device may again dynamically adapt its power consumption and/or functionality by reverting back to operating in the same way that the device initially operated when the power was previously of high quality (e.g., providing maximum functionality, decreasing power consumption to improve efficiency, or other adaptations).

In this way, despite receiving low quality power at times, the device need not rely on additional, often expensive filter components or operate less efficiently, using techniques that require a constant increase in energy consumption just to maintain functionality when power is of low quality. Instead, the techniques and circuits described herein may enable a device to function using less power be switching between consuming more energy to compensate for disturbances in the power, and less energy when no disturbances are present. The device need not rely on additional filter components to prevent disturbances from reaching the device, rather the device can handle whatever quality of power the supply bus delivers. The device may dynamically adapt its power consumption and/or functionality to change with changes in power quality and as such, may enable a device to operate more at a lower cost, more efficiently, and with increased reliability, thereby strengthening user confidence in the system.

FIG. 1 is a conceptual diagram illustrating system 1A that includes device 6A configured to receive power from power bus 14. System 1A is an example of a system that may not always provide a source of consistently high quality power. That is, the power device 6A receives from power bus 14 of system 1A may be "low quality at times and include disturbances (e.g., over voltage or current conditions, under voltage or current conditions, load dumps, voltage ringing, voltage or current spikes, large and small electrical transients, or other disturbances or artifacts).

Numerous examples of system 1A exist, and may include, but are not limited to, vehicle systems, computer systems, propulsion systems, or any other type of system that includes one or more devices receive receiving power from a shared power bus, which at times, may provide unstable or low quality electrical power. For example, an automobile system is one example of system 1A; such an automobile system typically includes an automotive power net that sometimes suffers from having over voltage or current conditions, under voltage or current conditions, load dumps, voltage ringing, voltage or current spikes, large and small electrical transients, and the like. As such, an electrical device, such as an electronic control unit (ECU), which receives its power from the automotive power net, may be exposed to disturbances in the power received from the automotive power net.

System 1A includes power source 2, device 6A, and optionally, load 4 and filter component 8. Power source 2 provides electrical energy to system 1A via power bus 14. Numerous examples of power source 2 may exist depending on the application of system 1A, including, but not limited to, power grids, generators, transformers, other types of batteries, solar/wind/hydro plants, regenerative braking systems, or any other type of AC or DC source capable of providing electrical energy (e.g., a voltage, a current) to system 1A.

Device 6A represents any electrical device that may at times receive low quality power from a power bus, such as power bus 14. Device 6A uses the power provided by power source 2, via power bus 14, to perform an operation, such as powering load 4, despite the fact that by the time device 6A receives the power from power source 2, the power may have disturbances and be of low quality or otherwise not be of high quality. Numerous examples of device 6A exist, such as, an electronic control unit (ECU), a component or subsystem of an ECU, an integrated semiconductor device, a component of a vehicle system, a computer system, a propulsion system, or any other type of system that may receive unstable or of low quality electrical power from a power bus.

Filter component 8 is an optional component that is arranged between power source 2 and device 6A to filter or remove disturbances that may appear in the power as it travels across power bus 14 from reaching device 6A. Although shown as an external component of device 6A, in some examples, filter component 8 may be an internal component of device 6A. In any event, filter component may increase the quality of the power destined for device 6A by removing at least some of the disturbances from the power before the power reaches device 6A. By removing some of the disturbances, filter component 8 may prevent device 6A from ever having to receive low quality power. Although filter component 8, may enable device 6A to maintain its functionality despite the appearance of disturbances in the power that travels across power bus 14, filter component 8 may increase the overall size, complexity, and/or cost of device 6A and/or system 1A.

Load 4 comprises an optional component that is coupled to device 6A via link 16. Load 4 receives power from, and is controlled by device 6A. For example, load 4 may be a lighting system, a fluid or vapor pump, a brake actuator, an electric motor, or any other component capable of being controlled and powered by a device, such as device 6A, that receives power from a power bus. For instance, load 4 may be a lighting system that device 6A causes to switch-on and switch-off, load 4 may be a fluid or vapor pump that device 6A operates to control the amount of fluid or gas in a tank, and the like.

In some examples, load 4 may require device 6A to perform power regulation functions for load 4. As such, device 6A may regulate a voltage or current output to ensure that the voltage or current output satisfies a power threshold for powering load 4.

As shown in FIG. 1, device 6A includes control module 12A and power circuitry 10. Power circuitry 10 represents any component or circuitry, of a device, that relies on the power being received from power bus 14 to perform an operation (e.g., powering load 4). For example power circuitry 10 may be a DC/AC, DC/DC, or AC/DC converter, a switch, an H-bridge, a half-bridge, a rectifier circuit, a voltage regulator, a current regulator, and the like that changes the voltage and/or current level associated with the power received by load 4. Power circuitry 10 is controlled by control module 12A to perform its intended function.

Control module 12A provides command and control signals to power circuitry 10 to cause power circuitry 10 to perform an operation. Control module 12A may cause power circuitry 10 to output a voltage or current at link 16 that has a form or magnitude defined by the command and control signals produced by control module 12A.

Control module 12A can comprise any suitable arrangement of hardware, software, firmware, or any combination thereof, to perform the techniques attributed to control module 12A herein. For example, control module 12A may include any one or more microprocessors, digital signal processors (DSPs), application specific integrated circuits (ASICs), field programmable gate arrays (FPGAs), or any other equivalent integrated or discrete logic circuitry, as well as any combinations of such components. When control module 12A includes software or firmware, control module 12A further includes any necessary hardware for storing and executing the software or firmware, such as one or more processors or processing units.

In general, a processing unit may include one or more microprocessors, DSPs, ASICs, FPGAs, or any other equivalent integrated or discrete logic circuitry, as well as any combinations of such components. Although not shown in FIG. 1, control module 12A may include a memory configured to store data. The memory may include any volatile or non-volatile media, such as a random access memory (RAM), read only memory (ROM), non-volatile RAM (NVRAM), electrically erasable programmable ROM (EEPROM), flash memory, and the like. In some examples, the memory may be external to control module 12A and/or device 6A, e.g., may be external to a package in which control module 12A and/or device 6A is housed.

As indicated above, device 6A may not always receive high quality power from power bus 14. That is, the power device 6A receives from power bus 14 may be of low quality and include disturbances (e.g., various types of oscillations, over voltage or current conditions, under voltage or current conditions, load dumps, voltage ringing, voltage or current spikes, large and small electrical transients, or other disturbances or artifacts). Although filter component 8 may remove at least some disturbances associated with the power received from power source 2, the power that device 6A ultimately receives from power bus 14 may not always be of high quality.

Figure 2A:
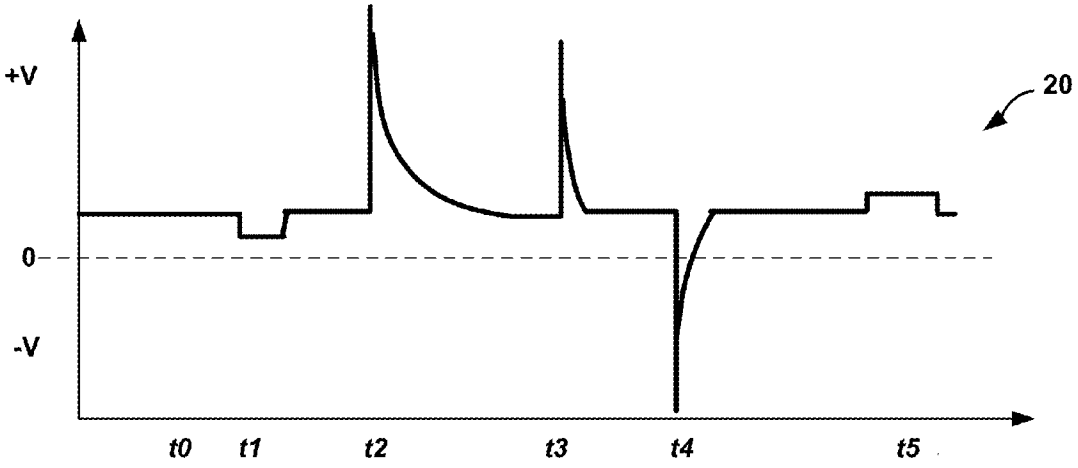
FIGS. 2A and 2B are waveform diagrams illustrating example electrical characteristics associated with the power on the power bus of the system of FIG. 1.
Figure 2B:
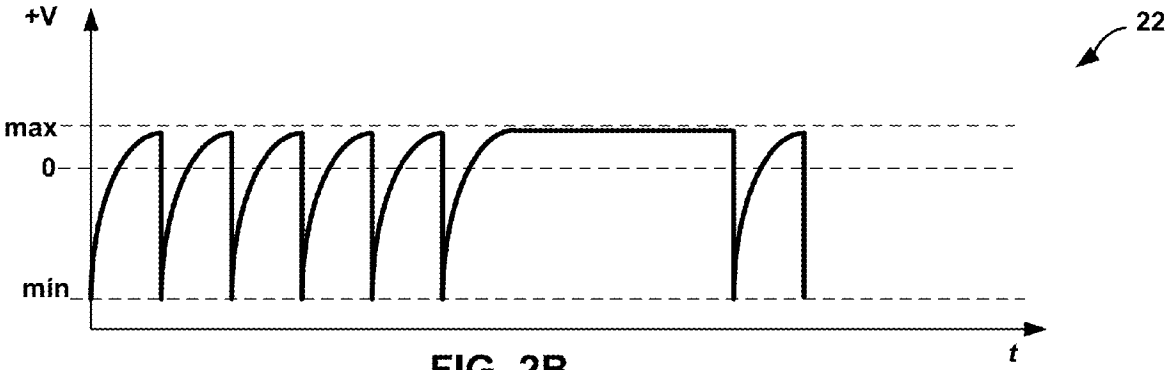

FIGS. 2A and 2B are waveform diagrams illustrating example electrical characteristics associated with the power that may appear on power bus 14 of system 1A of FIG. 1. Plot 20 of FIG. 2A shows examples of various changes that may occur, between times t0 and t5, to the voltage level associated with the power at power bus 14 which is supplied by power source 2. In the example of FIGS. 2A and 2B, power bus 14 is an automotive power net of an automobile and power source 2 is a battery.

FIG. 2A shows that at time t0, the voltage associated with the power at power bus 14 may be at a nominal, positive level. At time t1, the engine of the automobile begins to crank. During engine crank, power source 2 may be tasked with providing current to an electric starter and consequently, the voltage across power bus 14 may dip slightly below the nominal level. At time t2, the voltage across power bus 14 may spike as a result of a load dump occurring. For example, prior to time t2, power source 2 was being charged by an alternator. At time t2, during a charging cycle of power source 2, power source 2 is abruptly disconnected from the alternator which causes the voltage level across power bus 14 to spike.

At times t3 and t4, electrical magnetic interference from any number of sources inside or outside the automobile may introduce noise at power bus 14 and cause the voltage across power bus 14 to spike sharply above or dip sharply below the nominal level. At time t5, power source 2 is jump started which causes a momentary increase in the voltage across power bus 14 above nominal.

Plot 22 of FIG. 2B shows an example of the voltage or current level associated with the power received by device 6A from power bus 14 after the power has been filtered by filter component 8. FIG. 2B shows a saw tooth waveform that represents the voltage or current level varying between maximum and minimum levels. As a result of the filtering performed by filter component 8, the voltage or current level of the power that device 6A receives, never exceeds the maximum level.

Plots 20 and 22 of FIGS. 2A and 2B show that the power that device 6A receives from power bus 14 may not always be of high quality and free from disturbances. Since the power may not always be of high quality, in some examples, device 6A may perform techniques that cause device 6A to have a constant, increased amount of energy consumption. For example, control module 12A may cause a regulation loop associated power circuitry 10 to constantly run at a higher rate as a way for device 6A to compensate for potential disturbances (e.g., voltage spikes) with the power being received from power bus 14

By causing power circuitry 10 to have a faster regulation loop, control module 12A may prevent voltage or current overages, spikes, ringing, and transients from damaging or otherwise interfering with operations of device 6A and load 4. However, constantly running with a faster regulation loop typically expends more energy.

By using more energy to perform an operation that is otherwise required, device 6A functions less efficiently. That is, the constant potential threat of disturbances in the power received by device 6A may cause device 6A to regularly use a greater amount of energy than would otherwise be used if the power device 6A received was always of high quality.

In addition to being less efficient, increasing the energy consumed by device 6A, simply to protect device 6A from potential low quality power, may cause device 6A to have fewer "low power" modes of operation. Said differently, a "low power" mode of device 6A may consume too much energy to constitute being "low power" for some applications.

Furthermore, even with reliance on filter component 8 and/or constantly using faster regulation loops, the power device 6A receives via power bus 14 may still not be of high enough quality to enable device 6A to perform its intended function. In other words, the power device 6A receives may at times prevent device 6A from performing its intended function causing device 6A to be prone to functional failures and not always function when system 1A requires. Unreliability may weaken user confidence in system 1A, may lead to engineering re-designs, and/or may increase verification costs.

Figure 3:
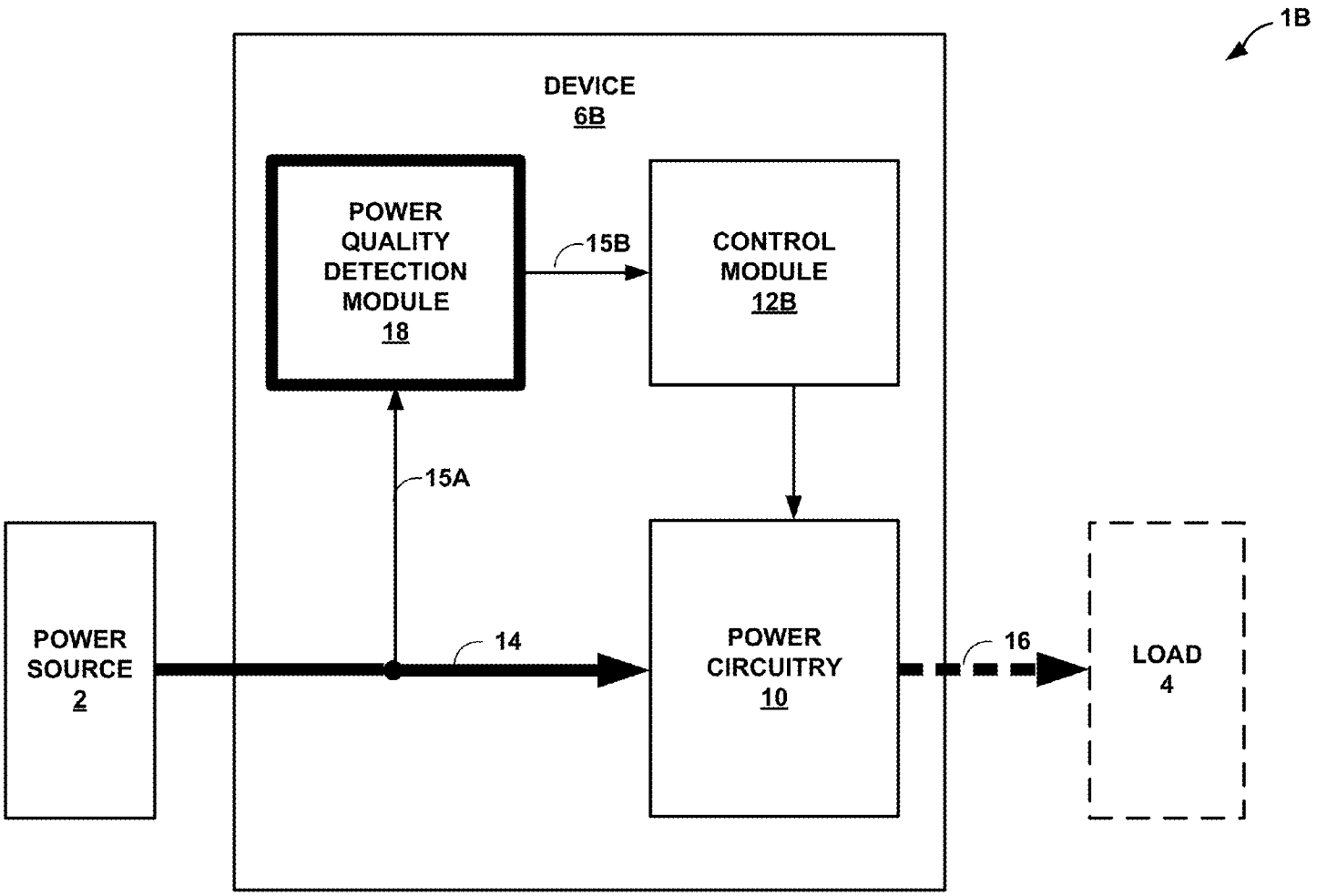
FIG. 3 is a conceptual diagram illustrating a system that includes an example device configured to dynamically adapt to changes in quality of power being received from a power bus, in accordance with one or more aspects of the present disclosure.

FIG. 3 is a conceptual diagram illustrating system 1B that includes device 6B which is configured to dynamically adapt to changes in quality of power being received from power bus 14, in accordance with one or more aspects of the present disclosure. One example of device 6B includes an ECU of an automobile, however, numerous examples of device 6B exist, such as, a component of a vehicle system, a computer system, a propulsion system, or any other type of system that may receive unstable or of low quality electrical power from a power bus.

Similar to system 1A of FIG. 1, system 1B includes power source 2 coupled to device 6B via power bus 14. Device 6B is coupled to optional load 4 via link 16.

Rather than rely on additional, often-times expensive and/or complex, filter components such as filter component 8 of FIG. 1, system 1B does not include any filters between power source 2 and device 6B. Instead, system 1B relies on the inherent ability of device 6B to maintain its functionality despite disturbances appearing in the power received from power bus 14. That is, device 6B is configured to determine the quality of the power received from power bus 14. When disturbances do not exist in the power that device 6B receives from power bus 14, and device 6B determines the power to be of high quality, device 6B configures itself to operate as efficiently as possible. However, when device 6B identifies one or more disturbances that degrade the quality of the power received from power bus 14, device 6B dynamically takes action to compensate for any degradation in the quality of the power while still maintaining its functionality.

Device 6B includes controller unit 12B, power circuitry 10, and power quality detection (PQD) module 18. While power circuitry 10 is primarily composed of hardware (e.g., circuitry), PQD module 18 and control module 12B can comprise any suitable arrangement of hardware, software, firmware, or any combination thereof, to perform the techniques attributed to PQD module 18 and control module 12B as described herein. For example, either PQD module 18 and/or control module 12B may include any one or more microprocessors, digital signal processors (DSPs), application specific integrated circuits (ASICs), field programmable gate arrays (FPGAs), or any other equivalent integrated or discrete logic circuitry, as well as any combinations of such components. When either PQD module 18 or control module 12B includes software or firmware, each also includes any necessary hardware for storing and executing the software or firmware, such as one or more processors or processing units. Although not shown in FIG. 3, either PQD module 18 or control module 12B may include a memory configured to store data. The memory may include any volatile or non-volatile media. In some examples, the memory may be external to PQD module 18 and control module 12B and/or device 6B.

PQD module 18 represents a detector for power bus stability. That is, PQD module 18 may determine the quality level of the power that device 6B receives from power bus 14. PQD module 18 may output information (e.g., data) to control module 12B that indicates the determined quality level of the power device 6B receives via power bus 14. For example, PQD module 18 may sample, via link 15A, the power being received from power bus 14. PQD module 18 may determine whether disturbances are identifiable from the power received from power bus 14. Examples of disturbances include an over-voltage or over-current condition, an under-voltage or under-current condition, a load dump condition, a voltage-ringing or current-ringing condition, a voltage-spike or current spike condition, or a voltage or current transient. As is described in detail with respect to the additional FIGS., in some examples, PQD module 18 may sample the power and apply a wavelet transform (e.g., a Mexican hat type wavelet transform, a Haar type wavelet transform, and the like) or a Fourier transform, to the sampled power, to isolate and identify any disturbances that may be present in the power being received from power bus 14.

In general, a wavelet is a wave-like oscillation with an initial amplitude of close to zero, which abruptly increases, and then decreases back to zero. For instance, a wavelet can be visualized as a momentary or brief oscillation in a signal (e.g., similar to the oscillations that may be output from a seismograph, a heart monitor, or other signal output equipment). Wavelets may have specific properties that make them identifiable for signal processing. For example, a wavelet may have properties that correspond to noise or other disturbances that may appear in a power signal typically sampled from a power bus.

Wavelet and Fourier transformations can be applied to portions of a known signal, such as a power signal, to extract information associated with an unknown signal that may overlap with the known signal. That is, as a mathematical tool, wavelet and Fourier transforms can be used to extract information such as noise or other disturbances from electrical signals. Sets or "banks" of wavelet or Fourier transforms may be used to better analyze a sampled signal. A set of "complementary" wavelets or Fouriers may decompose data without gaps or overlap so that the decomposition process is mathematically reversible.

By applying wavelet or Fourier transforms to the sampled power signal, the device may determine the power is of high quality if free from any disturbances or of low quality if inclusive of some disturbances. PQD module 18 may output, via link 15B, a first signal to control module 12B that indicates the power received via power bus 14 is free from disturbances and is therefore, of a higher quality. PQD module 18 may output, via link 15B, a second signal to control module 12B that indicates the power received via power bus 14 includes some disturbances and is therefore, of a lower quality, or low quality.

Control module 12B may rely on the signals or information received from PQD module 18 to control power circuitry 10. Based on the signals or information received from PQD module 18, control module 12B may configure power circuitry 10 of device 6B to perform an operation according to the quality level of the power received from power bus 14. In other words, control module 12B may adapt the power consumption or functionality of device 6B to suit the stability or lack thereof of power bus 14. For example, control module 12B may control power circuitry 10 to adjust when and what form or magnitude of output voltage or current, that device 6B provides at link 16.

In this way, despite receive receiving low quality power at times from power bus 14, device 6B need not rely on additional, often expensive filter components, such as filter component 8. Device 6B may cost less or be packable in a smaller size as compared to device 6C. In addition, rather than constantly operate less efficiently (e.g., using techniques that require a constant increase in energy consumption just to maintain functionality when power is of low quality), the techniques and circuits described herein may enable device 6B to function using less power be switching between consuming more energy to compensate for disturbances in the power, and less energy when no disturbances are present. Device 6B need not rely on additional filter components to prevent disturbances from reaching the device, rather the device can handle whatever quality of power the supply bus delivers. Device 6B may dynamically adapt its power consumption and/or functionality to change with changes in power quality and as such, may enable device 6B to operate at a lower cost, more efficiently, and with increased reliability, thereby strengthening user confidence in system 1B.

Figure 4:
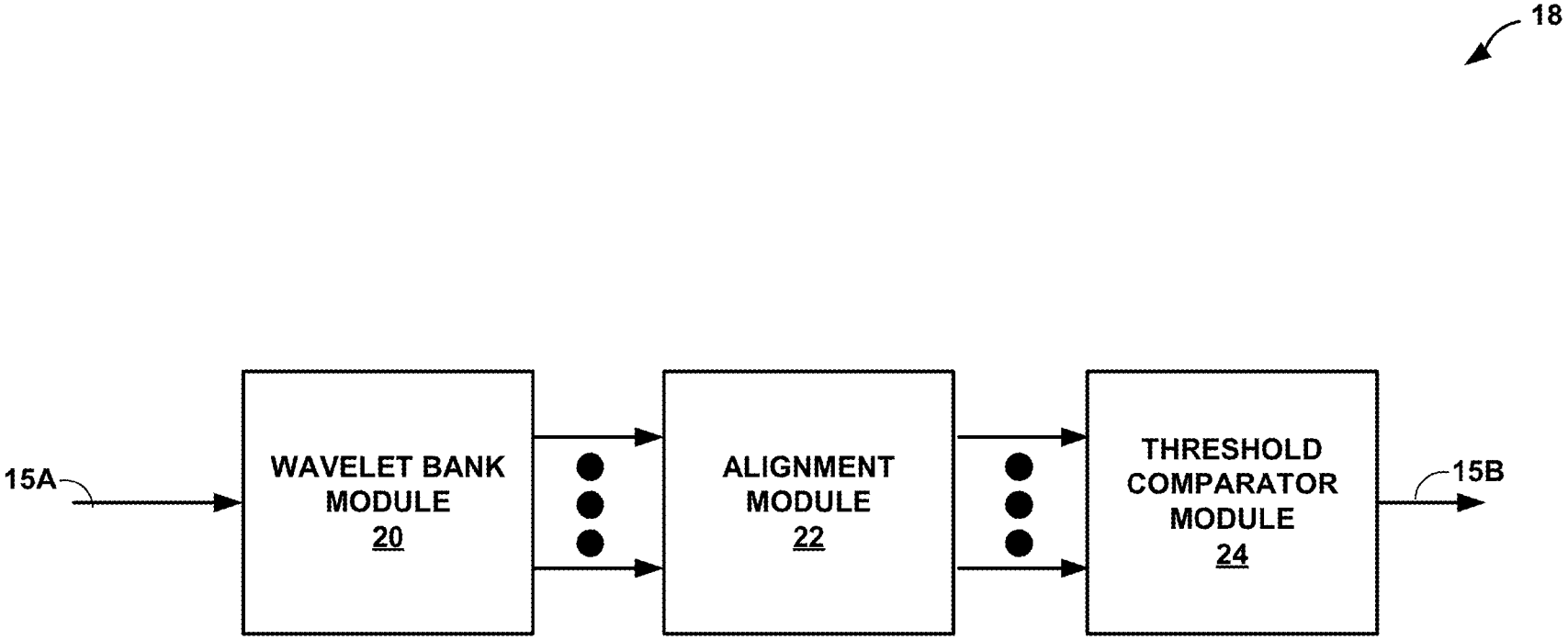
FIG. 4 is a conceptual diagram illustrating an example power quality detection module of the example device of FIG. 3.

FIG. 4 is a conceptual diagram illustrating an example of PQD module 18 of device 6B of FIG. 3. PQD module 18 includes wavelet bank module 20, alignment module 22, and threshold comparator module 24. FIG. 4 is just one example of PQD module 18, and PQD module 18 may include additional or fewer modules and components than what is shown in FIG. 4. PQD module 18 may determine whether any disturbances (e.g., appearing as high frequency oscillations with high or low amplitude peaks) are identifiable from the power being received by device 6B from power bus 14. Although described primarily using wavelets and wavelet transforms, the following techniques are as applicable using other signal transformation techniques. For instance, Fourier transforms, in addition or as opposed to Wavelet transforms, may be used to isolate disturbances that appear as oscillations, from a power signal. Likewise, any other suitable techniques for identifying oscillations that appear as disturbances in a power signal may be used by PQD module 18.

Wavelet bank module 20 may perform power sampling and waveform transformation techniques on the power being received by device 6B to isolate any disturbances from the rest of the power. That is, wavelet bank module may sample, via link 15A, the power received from power bus 14 to produce a function based on the power received from the power bus. The function may represent the voltage and/or current level of the power that is being received in a time and/or frequency domain.

Wavelet bank module 20 may apply at least one wavelet transform to the function. For example, wavelet bank module 20 may be an "n-level" wavelet bank that applies a quantity of "n" wavelet transforms of varying type (e.g., a Mexican hat type wavelet transform, a Haar type wavelet transform, a Daubechies type wavelet transform, or a Morelet type wavelet transform, and the like) to the function. The one or more outputs of wavelet bank module 20 may be information indicating various moments in time, during the sampling of the power on bus 14, when the voltage or current level of the power exceeded a threshold or oscillated at an abnormal frequency.

If multiple wavelet transforms are performed on the sampled power signal, alignment module 22 may temporarily align the various outputs of wavelet bank module so that the several outputs from wavelet bank module 20 can be compared contemporaneously. In other words, wavelet bank module 20 may take a different amount of time to perform each of the different wavelet transforms and the outputs from wavelet bank module 20 may not arrive at alignment module 22 simultaneously. As alignment module 22 receives each output from wavelet bank module 20, alignment module 22 may shift, and line-up, the outputs of wavelet bank module 20 so that each corresponds to a common time stamp going forward.

The one or more outputs from alignment module 22 may be received by threshold comparator module 24. Threshold comparator module 24 may compare each of the one or more outputs from alignment module 22 to one or more soft, minimum, and/or maximum thresholds to determine whether any oscillations in the power signal from bus 14 has a sufficiently large oscillation to warrant device 6B to take action in response. In other words, comparator module 24 may isolate, from an output of a wavelet transform, any disturbances associated with the power being received from power bus 14, from remaining portions of the power being received from power bus 14.

In some examples, threshold comparator module 24 may determine that the quality level of the power being received from power bus 14 is of a low-quality in response to identifying disturbances that have been isolated from the output of the wavelet transform, that exceed certain thresholds. Conversely, threshold comparator module 24 may determine that that the quality level of the power being received from power bus 14 is of a high-quality in response to failing to isolate, or failing to identify any disturbances from the output of the wavelet transform, that exceed certain thresholds.

Figure 5:
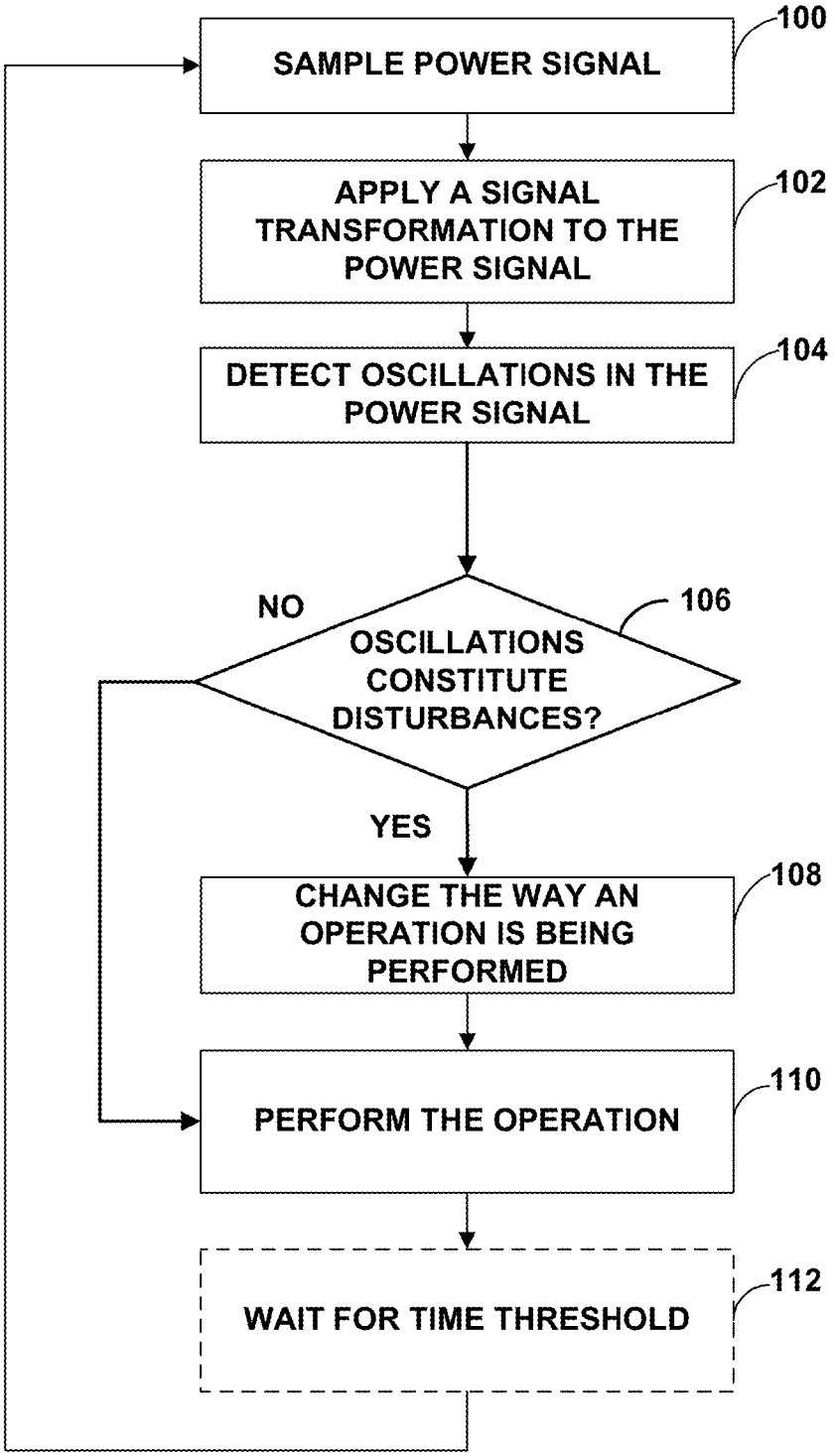
FIG. 5 is a flow chart illustrating example operations of the example device of FIG. 3 for dynamically adapting to changes in quality of power being received from a power bus, in accordance with one or more aspects of the present disclosure.

FIG. 5 is a flow chart illustrating example operations of device 6B of FIG. 3 for dynamically adapting to changes in quality of power being received from power bus 14, in accordance with one or more aspects of the present disclosure. FIG. 5 is described below within the context of system 1B of FIG. 3. Operations 100-112 of FIG. 5 may be performed by one or more modules of device 6B, such as PQD module 18 and control module 12B. In some examples, device 6B may comprise non-transitory computer-readable storage medium including instructions, that when executed by at least one processor of device 6B, configure 6B to perform operations 100-112 of FIG. 5.

Device 6B may sample a power signal (100). For example, device 6B may receive, from power bus 14, at least some of power supplied by power source 2. PQD module 18 of device 6B may sample the power being received by device 6B from power bus 14 and produce a temporal function indicative of the voltage or current level of the power signal during the period of time in which the power is sampled. PQD module 18 of device 6B may analyze the temporal function to determine a quality level of the power being received from power bus 14.

Device 6B may apply a signal transformation to the power signal (102). For example, PQD module 18 may apply a wavelet transformation, Fourier transformation, or other type of transformation to the temporal function produces from the sampled power to determine whether any oscillations that constitute disturbances exist in the power being received from power bus 14.

Device 6B may detect oscillations in the power signal (104). For example, PQD module 18 may analyze the output of the signal transform applied to the temporal function of the power to determine whether any oscillations have been isolated.

Device 6B may determine whether the oscillations constitute disturbances (106). For example, PQD module 18 may compare any oscillations that are identifiable from the signal transform to one or more thresholds to determine whether any constitutes a disturbance. If an oscillation has a sufficiently large amplitude that satisfies a threshold, PQD module 18 may determine that the oscillation is a disturbance. If an oscillation does not have a sufficiently large amplitude that satisfies a threshold, PQD module 18 may determine that the oscillation is not an disturbance. PQD module 18 may rely on the one or more thresholds to isolate the oscillations that constitute disturbances from all the oscillations that are identifiable from the power being received from power bus 14.

PQD module 106 may determine a quality level of the power being received from power bus 14. For example, PQD module 18 may determine that the quality level of the power is of a low-quality in response to identifying the disturbances after isolating the disturbances from the output of a signal transform. PQD module 18 may determine that the quality level of the power is of a high-quality in response to failing to isolate the disturbances from the output of the signal transform.

In response to identifying one or more disturbances, device 6B may change the way an operation is being performed (108). Said another way, device 6B may perform an operation according to the quality level of the power being received from power bus 14.

For example, PQD module 18 may output an indication (e.g., data) of the quality level of the power being received from power bus 14 to control module 12B. Control module 12B may control power circuitry 10 based on the quality level.

In some examples, device 6B may be configured to perform the operation of the according to the quality level of the power by at least selecting and enabling a first feature for performing the operation in response to determining that the quality level of the power is of a high-quality, selecting and enabling a second feature (e.g., the first feature being different than the second feature) for performing the operation in response to determining that the quality level of the power is of a low-quality. For instance, device 6B may perform an operation such as current or voltage regulation of an output of device 6B (e.g., for load 4 coupled to link 16). The first feature that control module 12B selects and enables may be a first regulation loop that uses a first amount of energy to perform the current or voltage regulation of the output of the device when the power is of a high quality. The second feature may be a second regulation loop that uses a second amount of energy that is greater than the first amount of energy to perform the current or voltage regulation of the output of the device when the power is of a low quality. In this way, the voltage regulation of the output of device 6B does not suffer even though the quality of the power being received from power bus 14 may degrade.

In some examples, device 6B may be configured to perform the operation according to the quality level of the power by adjusting an amount of the power being received from the power bus based on the quality level of the power. Said another way, device 6B may change the way an operation is being performed (108) by increasing the amount of the power being received from power bus 14 in response to determining that the quality level of the power has changed from being of a high-quality to a low-quality. In other examples, device 6B may change the way an operation is being performed (108) by decreasing the amount of the power being received from power bus 14 in response to determining that the quality level of the power has changed from being of a low-quality to a high-quality.

For instance, in some examples, where device 6B is a voltage or current regulator and control module 12B is configured to adjust the amount of the power being received by at least increasing a speed of a regulation-loop of power circuitry 10 in response to determining that the quality level of the power has changed from being of a high-quality to a low-quality. In some examples, control module 12B is configured to adjust the amount of the power being received by at least decreasing the speed of the regulation-loop of power circuitry 10 in response to determining that the quality level of the power has changed from being of the low-quality to the high-quality.

Device 6B may perform the operation (110). For example, device 6B may be configured to perform voltage regulation for load 4. Using the selected regulation loop from operation 108, device 6B may regulate the voltage.

In some examples, device 6B may wait for a time threshold (112) before repeating operations 100-112. Said differently, device 6B may be configured to continue performing the operation of the device according to the quality level of the power for at least a threshold amount of time before determining a quality level of the power and/or changing how the operation is performed. In this way, any lag or delay that may be attributed to determining whether the quality before performing the operation according to the quality of the power can be minimized.

Figure 6:
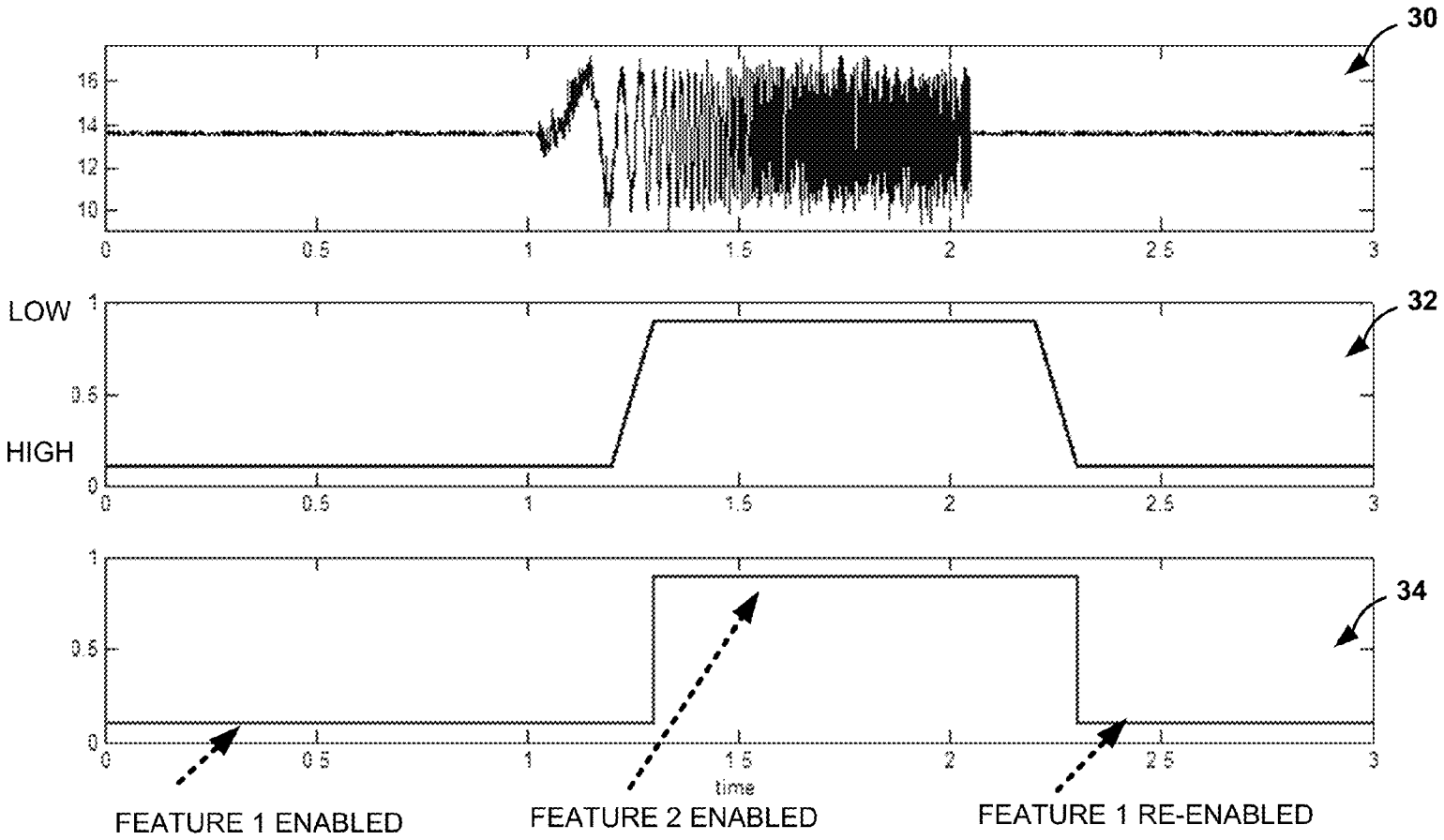
FIG. 6 are waveform diagrams illustrating example electrical characteristics of the example device of FIG. 3 while performing the operations of FIG. 5, in accordance with one or more aspects of the present disclosure.

FIG. 6 are waveform diagrams illustrating example electrical characteristics of device 6B of FIG. 3 while performing operations 100-112 of FIG. 5, in accordance with one or more aspects of the present disclosure. FIG. 6 is described within the context of system 1B of FIG. 3 and operations 100-112 of FIG. 5.

Plot 30 shows a voltage or current level of power being sampled between time 0 and 3 as device 6B receives the power from power bus 14. At around time 1, oscillations (e.g., disturbances) begin to appear in the power on power bus 14.

Plot 32 shows a binary signal representing the quality level of the power being received by power bus 14, as determined by PQD module 18. For example, after time 1, PQD module may identify the oscillations that are present in the power on bus 14. PQD module 18 may output a signal to control module 12B indicating the change in the quality of power.

Plot 34 shows a binary signal representing the feature that is selected and enabled for performing an operation according to the quality of the power as determined by PQD module 18. In some examples, the feature may correspond to an "operational state" of a state machine of control module 12B. For example, when PQD module 18 does not detect any disturbances and outputs information indicating the quality of the power is of a high-quality, control module 12B may operate in a first state (e.g., and use a slower regulation loop). And when PQD module 18 does detect one or more disturbances and outputs information indicating the quality of the power is of a low-quality, control module 12B may operate in a second state (e.g., and use a faster regulation loop). In any event, plot 34 shows device 6B performing an operation according to the quality of the power being received from power bus 14.

Figure 7:
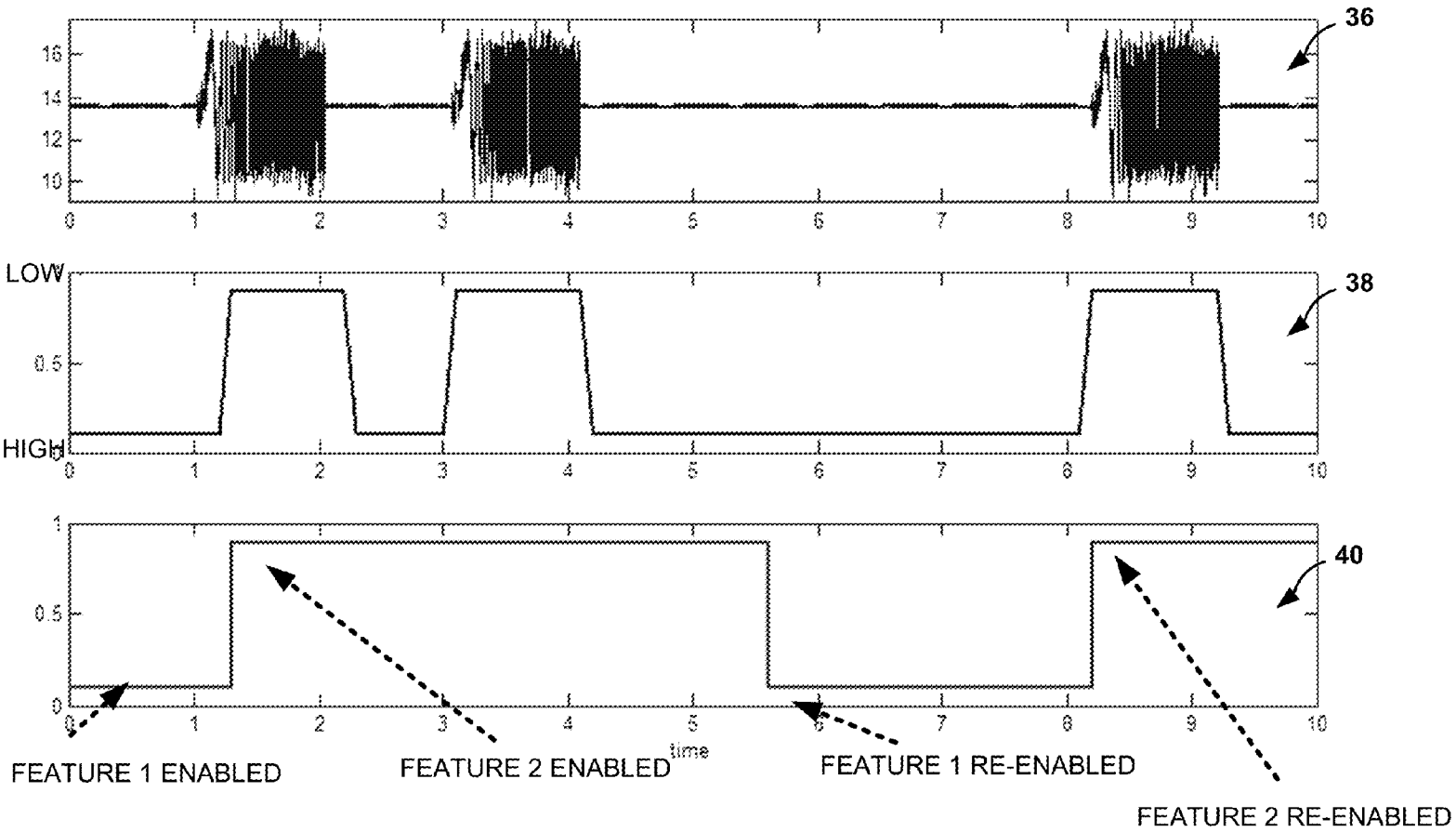
FIG. 7 are additional waveform diagrams illustrating additional example electrical characteristics of the example device of FIG. 3 while performing the operations of FIG. 5, in accordance with one or more aspects of the present disclosure.
Figure 8A:
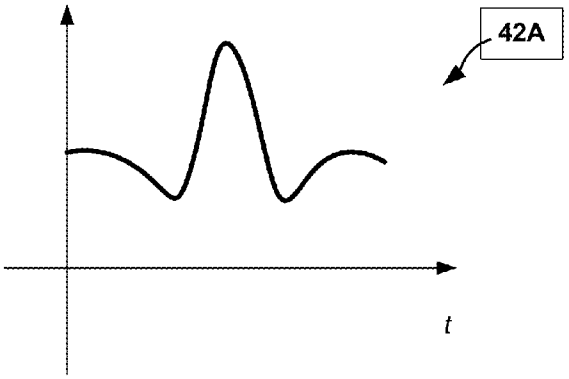
FIGS. 8A-8D are waveform diagrams illustrating example wavelets that may be used by the example device of FIG. 3 for performing the operations of FIG. 5, in accordance with one or more aspects of the present disclosure.
Figure 8B:
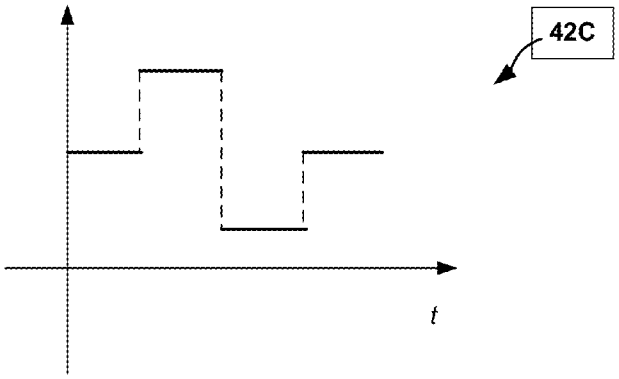
Figure 8C:
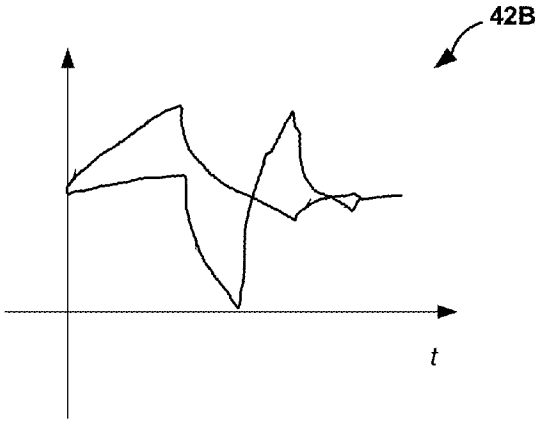
Figure 8D:
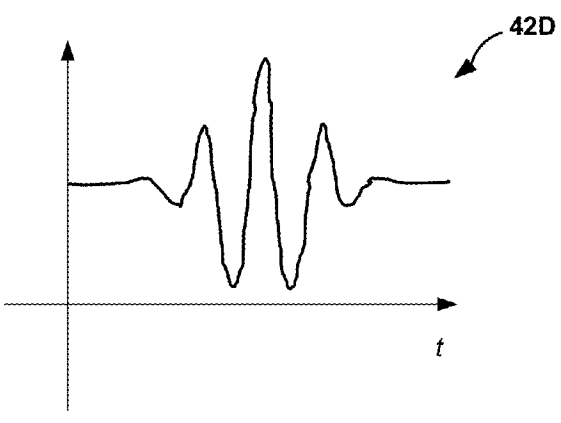

FIG. 7 are additional waveform diagrams illustrating example electrical characteristics of device 6B of FIG. 3 while performing operations 100-112 of FIG. 5, in accordance with one or more aspects of the present disclosure. FIG. 7 is described within the context of system 1B of FIG. 3 and operations 100-112 of FIG. 5.

FIG. 7 shows how in some examples, device 6B may wait for a time threshold (112) before repeating operations 100-112. Said differently, device 6B may be configured to continue performing the operation of the device according to the quality level of the power for at least a threshold amount of time before determining a quality level of the power and/or changing how the operation is performed. In this way, device 6B can avoid the lag time that may be associated with detecting the quality of power and changing operational modes in response to the change.

Plot 36 shows a voltage or current level of power being sampled between time 0 and 10 as device 6B receives the power from power bus 14. At around time 1, oscillations (e.g., disturbances) begin to appear in the power on power bus 14 and end at time 2. Oscillations again appear in the power on power bus 14 at time 3 and end at time 4. Oscillations again appear in the power on power bus 14 at time 8 and end at time 9.

Plot 38 shows a binary signal representing the quality level of the power being received by power bus 14, as determined by PQD module 18. For example, after times 1, 3, and 8, PQD module may identify the oscillations that are present in the power on bus 14. PQD module 18 may output a signal to control module 12B indicating the change in the quality of power.

Plot 40 shows a binary signal representing the feature that is selected and enabled for performing an operation according to the quality of the power as determined by PQD module 18. Plot 40 shows how control module 12B may ignore a change in quality of power until a sufficient amount of time has passed since PQD module 18 last detected a change. For example, to minimize any disruption in the regulated output provided at link 16, control module 12B may cause power circuitry 10 to continue using a faster regulation loop after times 2, even though PQD module 18 may indicate after time 2 that the power quality has improved. Control module 12B may require the power quality to remain at the new level for a certain amount of time, after a change, to prevent any disruption in its performance of an operation. For instance, plot 40 shows that after time 5, control module 12B may determine that the quality level of the power has remained high for a minimal amount of time, and therefore, cause device 6B to revert back to using the slower regulation loop.

FIGS. 8A-8D are waveform diagrams illustrating example wavelets that may be used by device 6B of FIG. 3 for performing operations 100-112 of FIG. 5, in accordance with one or more aspects of the present disclosure. Plot 42A shows a Mexican hat type wavelet. Plot 42B shows a Haar type wavelet. Plot 42C shows a Daubechies type wavelet. And plot 42D shows a Morelet type wavelet. By applying one of the wavelet transforms shown in plots 42A-42D, to the sampled power signal based on the power on bus 14, device 6B may determine whether the power is of high quality and free from any disturbances or of low quality and inclusive of some disturbances.

Figure 9:
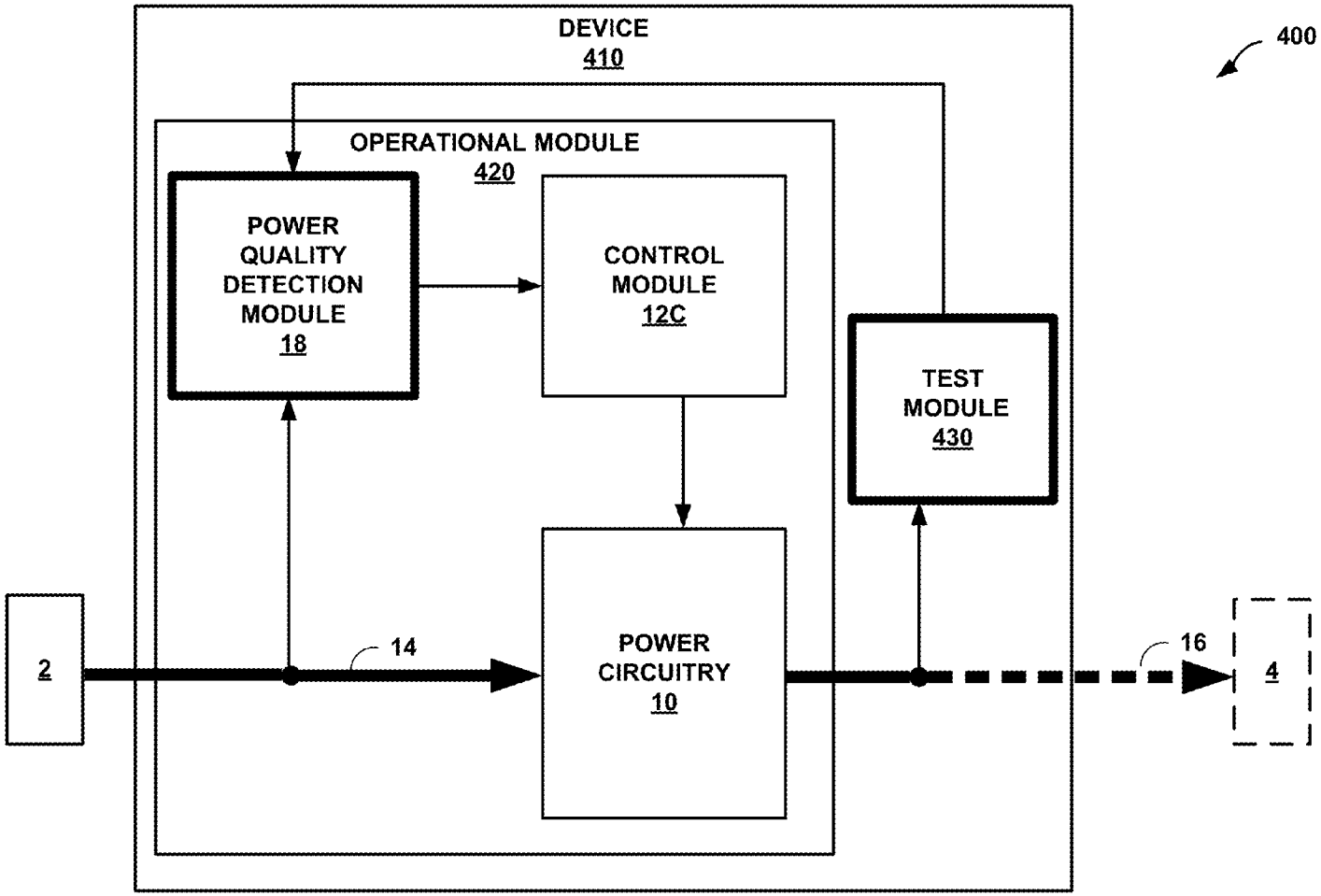
FIG. 9 is a conceptual diagram illustrating a system for performing operational testing of a device, in accordance with one or more aspects of the present disclosure.

FIG. 9 is a conceptual diagram illustrating system 400 for performing operational testing of device 410, in accordance with one or more aspects of the present disclosure. System 400 includes power bus 14, power source 2 which is configured to supply power to power bus 14, and device 410 which is configured to receive the power being supplied to power bus 14. Said differently, device 410 is supplied power from power bus 14. Device 410 includes operational module 420 and test module 430.

Although shown as being an internal component of device 410, in some examples, test module 430 is an external component of device 410 (e.g., part of a test bench for performing verification testing of device 410). In other examples, test module 430 is an internal component of device 410 and is configurable to perform verification testing during operational use. In some examples, power bus 14, operational module 410, and test module 430 comprise one or more internal components of a single device 410 that is configured to receive the power, via an automotive power net, that is being supplied power from a battery or alternator of an automobile.

Operational module 420 includes PQD module 18, control module 12C, and power circuitry 10. Operational module 420 is configured to receive, from power bus 14, at least some of the power supplied by power source 2 and perform an operation according to the quality level of the power by at least generating an output based on the power. For example, similar to device 6B, operational module 420 may perform voltage regulation techniques to provide a regulated voltage to load 4. Operational module 420 may adapt its voltage regulation to consumer more power when the quality of the power on bus 14 is of low-quality and consume less power when the quality of the power on bus 14 is of high-quality.

Test module 430 is configured to test operational module 420 by at least generating, based on a wavelet transform applied to the output, a temporal signal including disturbances that simulate a degradation in quality level, detected by operational module 420, of the power being received from power bus 14, and determining whether operational module 420 correctly performed the operation in response to the input of the disturbances. For example, even during times when the power on power bus 14 may be of high-quality and free from any disturbances, test module 430 may test whether operational module 420 can handle a degradation in power quality and correctly adapt is operation and functionality to better during the degradation.

Test module 430 may induce power instabilities at operational module 420. For example, test module 430 may sample the output of power circuitry 10 to deduce the power being received from power bus 14. Power circuitry 10 may apply a wavelet or Fourier transform to the sampled signal to produce a simulated power signal that includes disturbances and output the simulated signal to PDQ module 18. Rather than rely on a sampling of the actual power being received from power bus 14, PDQ module 18 may rely on the simulated power signal received from test module 430 and determine the quality of the simulated power. PDQ module 18 may output an indication of the quality of the simulated power to control module 12C which may configure power circuitry 10 to perform an operation accordingly.

Clause 1. A system comprising: a power bus; a power source configured to supply power to the power bus; a device configured to: receive, from the power bus, at least some of the power supplied by the power source; determine a quality level of the power received from the power bus; and perform an operation of the device according to the quality level of the power.

Clause 2. The system of clause 1, wherein the device is configured to determine the quality level of the power by at least determining whether disturbances are identifiable from the power received from the power bus.

Clause 3. The system of clause 2, wherein the device is further configured to determine whether the disturbances are identifiable from the power received from the power bus by at least: sampling the power received from the power bus to produce a function based on the power received from the power bus; applying a wavelet transform to the function; and isolating, from an output of the wavelet transform, the disturbances from remaining portions of the power received from the power bus.

Clause 4. The system of clause 3, wherein the device is further configured to determine the quality level of the power by: determining that the quality level of the power is of a low-quality in response to identifying the disturbances after isolating the disturbances from the output of the wavelet transform; and determining that the quality level of the power is of a high-quality in response to failing to isolate the disturbances from the output of the wavelet transform.

Clause 5. The system of any of clauses 3-4, wherein the wavelet transform comprises at least one of: a Mexican hat type wavelet transform; a Haar type wavelet transform; a Daubechies type wavelet transform; or a Morelet type wavelet transform.

Clause 6. The system of any of clauses 2-5, wherein the disturbances comprise at least one of: an over-voltage or over-current condition; an under-voltage or under-current condition; a load dump condition; a voltage-ringing or current-ringing condition; a voltage-spike or current spike condition; or a voltage or current transient.

Clause 7. The system of any of clauses 1-6, wherein the device is configured to perform the operation of the device according to the quality level of the power by at least: selecting and enabling a first feature for performing the operation in response to determining that the quality level of the power is of a high-quality; and selecting and enabling a second feature for performing the operation in response to determining that the quality level of the power is of a low-quality, wherein the first feature is different than the second feature.

Clause 8. The system of clause 7, wherein:

the operation is current or voltage regulation of an output of the device;

the first feature is a first regulation loop that uses a first amount of energy to perform the current or voltage regulation of the output of the device; and the second feature is a second regulation loop that uses a second amount of energy that is greater than the first amount of energy to perform the current or voltage regulation of the output of the device.

Clause 9. The system of any of clauses 1-8, wherein the device is configured to perform the operation according to the quality level of the power by: adjusting an amount of the power being received from the power bus based on the quality level of the power.

Clause 10. The system of clause 9, wherein the device is configured to adjust the amount of the power being received by at least: increasing the amount of the power being received from the power bus in response to determining that the quality level of the power has changed from being of a high-quality to a low-quality; or decreasing the amount of the power being received from the power bus in response to determining that the quality level of the power has changed from being of the low-quality to the high-quality.

Clause 11. The system of any of clauses 9-10, wherein the device comprises a voltage or current regulator and the device is configured to adjust the amount of the power being received by at least: increasing a speed of a regulation-loop of the voltage or current regulator in response to determining that the quality level of the power has changed from being of a high-quality to a low-quality; and decreasing the speed of the regulation-loop of the voltage or current regulator in response to determining that the quality level of the power has changed from being of the low-quality to the high-quality.

Clause 12. The system of any of clauses 1-11, wherein the device is further configured to continue performing the operation of the device according to the quality level of the power for at least a threshold amount of time.

Clause 13. The system of any of clauses 1-12, wherein the power bus is an automotive power net of an automobile, the power source is at least one of a battery or an alternator of the automobile, and the device is an electronic control unit of the automobile.

Clause 14. A method comprising: receiving, by a device, from a power bus coupled to a power source, at least some of power supplied by the power source; determining, by the device, a quality level of the power received from the power bus; and performing, by the device, an operation of the device according to the quality level of the power.

Clause 15. The method of clause 14, wherein determining the quality level of the power comprises: sampling, by the device, the power received from the power bus to produce a function based on the power received from the power bus; applying, by the device, a wavelet transform to the function; isolating, by the device, from an output of the wavelet transform, disturbances that are identifiable from the power received from the power bus from remaining portions of the power received from the power bus; determining, by the device, that the quality level of the power is of a low-quality in response to identifying the disturbances after isolating the disturbances from the output of the wavelet transform; and determining, by the device, that the quality level of the power is of a high-quality in response to failing to isolate the disturbances from the output of the wavelet transform.

Clause 16. The method of any of clauses 14-15, wherein performing the operation of the device according to the quality level of the power comprises: selecting and enabling, by the device, a first feature for performing the operation in response to determining that the quality level of the power is of a high-quality; and selecting and enabling, by the device, a second feature for performing the operation in response to determining that the quality level of the power is of a low-quality, wherein the first feature is different than the second feature.

Clause 17. The method of any of clauses 14-16, wherein: the operation is current or voltage regulation of an output of the device; the first feature is a first regulation loop that uses a first amount of energy to perform the current or voltage regulation of the output of the device; and the second feature is a second regulation loop that uses a second amount of energy that is greater than the first amount of energy to perform the current or voltage regulation of the output of the device.

Clause 18. The method of any of clauses 14-17, wherein performing the operation of the device according to the quality level of the power comprises adjusting, by the device, an amount of the power being received from the power bus to match the quality level of the power.

Clause 19. A system comprising: a power bus; a power source configured to supply power to the power bus; an operational module configured to: receive, from the power bus, at least some of the power supplied by the power source; and perform an operation according to the quality level of the power by at least generating an output based on the power; and a test module configured to test the operational module by at least: generating, based on a wavelet transform applied to the output, a temporal signal including disturbances that simulate a degradation in quality level, detected by the operational module, of the power being received from the power bus; and determining whether the operational module correctly performed the operation in response to the input of the disturbances.

Clause 20. The system of clause 19, wherein the power bus, the operational module, and the test module comprise one or more internal components of a device that is configured to receive the power, via an automotive power net, the power being supplied by a battery or alternator of an automobile.

Clause 21. The system of any of clauses 1-13, wherein the device is further configured to perform any of the methods of clauses 14-18.

Clause 21. The system of any of clauses 19-20, wherein at least one of the operational module or the test module are is further configured to perform any of the methods of clauses 14-18.

Clause 22. A non-transitory computer-readable storage medium comprising instructions that, when executed by at least one processor of a device, configure the device to perform any of the methods of clauses 14-18.

In one or more examples, the operations described may be implemented in hardware, software, firmware, or any combination thereof. If implemented in software, the operations may be stored on or transmitted over, as one or more instructions or code, a computer-readable medium and executed by a hardware-based processing unit. Computer-readable media may include computer-readable storage media, which corresponds to a tangible medium such as data storage media, or communication media including any medium that facilitates transfer of a computer program from one place to another, e.g., according to a communication protocol. In this manner, computer-readable media generally may correspond to (1) tangible computer-readable storage media, which is non-transitory or (2) a communication medium such as a signal or carrier wave. Data storage media may be any available media that can be accessed by one or more computers or one or more processors to retrieve instructions, code and/or data structures for implementation of the techniques described in this disclosure. A computer program product may include a computer-readable medium.

By way of example, and not limitation, such computer-readable storage media can comprise RAM, ROM, EEPROM, CD-ROM or other optical disk storage, magnetic disk storage, or other magnetic storage devices, flash memory, or any other medium that can be used to store desired program code in the form of instructions or data structures and that can be accessed by a computer. Also, any connection is properly termed a computer-readable medium. For example, if instructions are transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. It should be understood, however, that computer-readable storage media and data storage media do not include connections, carrier waves, signals, or other transient media, but are instead directed to non-transient, tangible storage media. Disk and disc, as used herein, includes compact disc (CD), laser disc, optical disc, digital versatile disc (DVD), floppy disk and Blu-ray disc, where disks usually reproduce data magnetically, while discs reproduce data optically with lasers. Combinations of the above should also be included within the scope of computer-readable media.

Instructions may be executed by one or more processors, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor," as used herein may refer to any of the foregoing structure or any other structure suitable for implementation of the techniques described herein. In addition, in some aspects, the functionality described herein may be provided within dedicated hardware and/or software modules. Also, the techniques could be fully implemented in one or more circuits or logic elements.

The techniques of this disclosure may be implemented in a wide variety of devices or apparatuses, including a wireless handset, an integrated circuit (IC) or a set of ICs (e.g., a chip set). Various components, modules, or units are described in this disclosure to emphasize functional aspects of devices configured to perform the disclosed techniques, but do not necessarily require realization by different hardware units. Rather, as described above, various units may be combined in a hardware unit or provided by a collection of interoperative hardware units, including one or more processors as described above, in conjunction with suitable software and/or firmware.

Various examples have been described. Many of the described examples concern techniques for communicating between the secondary and primary side of a flyback converter so as to enable the use of a common controller for both sides of the flyback converter. However, the described techniques for communicating between two sides of a transformer may also be used for other reasons, or in other transformer applications. These and other examples are within the scope of the following claims.

What is claimed is:

1. A system comprising:

a power bus;

a power source configured to supply power to the power bus; and a device configured to:

receive, from the power bus, at least some of the power supplied by the power source;

sample the power received from the power bus to produce a function based on the power received from the power bus;

apply a wavelet transform to the function;

isolating, from an output of the wavelet transform, disturbances that are identifiable from the power received from the power bus from remaining portions of the power received from the power bus;

determine a quality level of the power received from the power bus based on whether the disturbances that are identifiable from the power received from the power bus are isolated from the output of the wavelet transform; and perform an operation of the device according to the quality level of the power.

2. The system of claim 1 wherein the device is further configured to determine the quality level of the power by:

determining that the quality level of the power is of a low-quality in response to identifying the disturbances after isolating the disturbances from the output of the wavelet transform; and determining that the quality level of the power is of a high-quality in response to failing to isolate the disturbances from the output of the wavelet transform.

3. The system of claim 1 wherein the wavelet transform comprises at least one of:

a Mexican hat type wavelet transform;

a Haar type wavelet transform;

a Daubechies type wavelet transform; or a Morelet type wavelet transform.

4. The system of claim 1, wherein the disturbances comprise at least one of:

an over-voltage or over-current condition;

an under-voltage or under-current condition;

a load dump condition;

a voltage-ringing or current-ringing condition;

a voltage-spike or current spike condition; or a voltage or current transient.

5. The system of claim 1, wherein the device is configured to perform the operation of the device according to the quality level of the power by at least:

selecting and enabling a first feature for performing the operation in response to determining that the quality level of the power is of a high-quality; and selecting and enabling a second feature for performing the operation in response to determining that the quality level of the power is of a low-quality, wherein the first feature is different than the second feature.

6. The system of claim 5, wherein:

the operation is current or voltage regulation of an output of the device;

the first feature is a first regulation loop that uses a first amount of energy to perform the current or voltage regulation of the output of the device; and the second feature is a second regulation loop that uses a second amount of energy that is greater than the first amount of energy to perform the current or voltage regulation of the output of the device.

7. The system of claim 1, wherein the device is configured to perform the operation according to the quality level of the power by:

adjusting an amount of the power being received from the power bus based on the quality level of the power.

8. The system of claim 7, wherein the device is configured to adjust the amount of the power being received by at least:

increasing the amount of the power being received from the power bus in response to determining that the quality level of the power has changed from being of a high-quality to a low-quality; or decreasing the amount of the power being received from the power bus in response to determining that the quality level of the power has changed from being of the low-quality to the high-quality.

9. The system of claim 7, wherein the device comprises a voltage or current regulator and the device is configured to adjust the amount of the power being received by at least:

increasing a speed of a regulation-loop of the voltage or current regulator in response to determining that the quality level of the power has changed from being of a high-quality to a low-quality; and decreasing the speed of the regulation-loop of the voltage or current regulator in response to determining that the quality level of the power has changed from being of the low-quality to the high-quality.

10. The system of claim 1, wherein the device is further configured to continue performing the operation of the device according to the quality level of the power for at least a threshold amount of time.

11. The system of claim 1, wherein the power bus is an automotive power net, the power source is at least one of a battery or an alternator, and the device is an electronic control unit.

12. A method comprising:

receiving, by a device, from a power bus coupled to a power source, at least some of power supplied by the power source;

sampling, by the device, the power received from the power bus to produce a function based on the power received from the power bus;

applying, by the device, a wavelet transform to the function;

isolating, by the device, from an output of the wavelet transform, disturbances that are identifiable from the power received from the power bus from remaining portions of the power received from the power bus;

determining, by the device, that a quality level of the power received from the power bus is of a low-quality in response to identifying the disturbances after isolating the disturbances from the output of the wavelet transform;

determining, by the device, that the quality level of the power is of a high-quality in response to failing to isolate the disturbances from the output of the wavelet transform; and performing, by the device, an operation of the device according to the quality level of the power.

13. The method of claim 12, wherein performing the operation of the device according to the quality level of the power comprises:

selecting and enabling, by the device, a first feature for performing the operation in response to determining that the quality level of the power is of a high-quality; and selecting and enabling, by the device, a second feature for performing the operation in response to determining that the quality level of the power is of a low-quality, wherein the first feature is different than the second feature.

14. The method of claim 12, wherein:

the operation is current or voltage regulation of an output of the device;

the first feature is a first regulation loop that uses a first amount of energy to perform the current or voltage regulation of the output of the device; and the second feature is a second regulation loop that uses a second amount of energy that is greater than the first amount of energy to perform the current or voltage regulation of the output of the device.

15. The method of claim 12, wherein performing the operation of the device according to the quality level of the power comprises adjusting, by the device, an amount of the power being received from the power bus to match the quality level of the power.

16. A system comprising:

a power bus;

a power source configured to supply power to the power bus;

an operational module configured to:

receive, from the power bus, at least some of the power supplied by the power source; and perform an operation according to the quality level of the power by at least generating an output based on the power; and a test module configured to test the operational module by at least:

generating, based on a wavelet transform applied to the output, a temporal signal including disturbances that simulate a degradation in quality level, detected by the operational module, of the power being received from the power bus; and determining whether the operational module correctly performed the operation in response to the input of the disturbances.

17. The system of claim 16, wherein the power bus, the operational module, and the test module comprise one or more internal components of a device that is configured to receive the power, via an automotive power net, the power being supplied by a battery or alternator.

* * * * *